US005722815A

United States Patent [19]

Cozens

[11] Patent Number: 5,722,815

[45] Date of Patent: Mar. 3, 1998

[54] THREE STAGE SELF REGULATING GEROTOR PUMP

[75] Inventor: Eric R. Cozens, Burlington, Canada

[73] Assignee: Stackpole Limited, Mississauga, Canada

[21] Appl. No.: 515,054

[22] Filed: Aug. 14, 1995

[51] Int. Cl.[6] ..... F04C 15/02

[52] U.S. Cl. ..... 417/310; 417/288

[58] Field of Search ..... 417/288, 310

[56] References Cited

U.S. PATENT DOCUMENTS

| | | | |
|---|---|---|---|
| 2,446,730 | 2/1948 | Wemp . | |
| 3,067,689 | 12/1962 | Hause | 417/288 |
| 3,175,800 | 3/1965 | Donner et al. | 251/35 |
| 3,214,087 | 10/1965 | Lück . | |
| 3,224,662 | 12/1965 | Oldberg . | |
| 3,473,477 | 10/1969 | Thompson et al. . | |
| 4,022,551 | 5/1977 | Hirosawa | 417/440 |
| 4,597,718 | 7/1986 | Nakano et al. | 417/310 X |
| 5,338,161 | 8/1994 | Eley | 417/307 |

FOREIGN PATENT DOCUMENTS

| | | |
|---|---|---|
| 2 689 185 | 10/1993 | France . |
| 38 24 398 | 2/1989 | Germany . |
| 39 13 414 | 10/1990 | Germany . |
| 2 038 931 | 7/1980 | United Kingdom . |
| 86/06797 | 11/1986 | WIPO . |

*Primary Examiner*—Richard E. Gluck
*Attorney, Agent, or Firm*—Eugene J. A. Gierczak

[57] ABSTRACT

A gerotor pump is described for use with non-compressible fluids such as automotive coolant or hydraulic oil. The pump includes three separate pump outlet ports, a bypass return passage, find an integral four position spool valve. Increasing back pressure from a downstream load is sensed be the spool valve which moves accordingly to restrict the fluid supplied. In the first position a full flow fluid is supplied to the load from all three ports. In the second position one port is vented to the bypass and the flow from the other two ports is directed to the load. In the third position two ports vent to bypass, and one ports drives the load. In the fourth position all ports vent to bypass. In each case flow vented to bypass is not first compressed, permitting a smaller motor to be used.

18 Claims, 10 Drawing Sheets

THREE STAGE SELF REGULATING GEROTOR PUMP

FIELD OF INVENTION

This invention relates to gerotor pumps for pumping incompressible fluids, and in particular relates to pumps having a feedback sensing device and more than one outlet port. The feedback sensing device is used to reduce outlet flow as outlet back pressure increases, facilitating a reduction of input power requirements at non-critical operating conditions.

BACKGROUND OF THE INVENTION

Gerotor pumps have been known for many years. In general a machined lobate, eccentrically mounted rotor element interacts with a mating machined, lobate driven member and a chamber having a circular cross section. In a typical constant displacement liquid pump, the eccentrically mounted rotor element having n lobes cooperates with a surrounding lobate ring gear having n+1 lobes, itself contained within a close fitting cylindrical enclosure. Such constant displacement pumps are often used with non-compressible fluids, such as water or hydraulic oil.

In automotive use, it may be desirable to operate a fluid pump with a drive motor whose speed varies independently of the output flow requirement. The outlet pressure such a pump creates may be excessive depending on the nature of the flow demanded. For example, if motor speed, and therefore flow output is high, and the downstream requirement is low, it is desirable to divert flow back to the pump inlet to avoid excessive pressure in the system.

The design point for these pumps is usually determined by the flow rate and pressure developed at an idle speed under maximum temperature conditions. The pump may be driven directly from the main drive shaft, and will have an operating speed the same as, or directly proportional to, the engine generally. In these circumstances idle may correspond to a speed in the range of 1000 r.p.m. or less, and average speed may be in the 3000 to 4000 r.p.m. range. The same pump operating at very high speed, perhaps 7000 to 8000 r.p.m., will pump far more oil than is required, and may be capable of producing far greater pressures than necessary. In that case the majority of the oil will be directed back to the inlet. Traditionally a pressure relief valve is used to 'dump' the excess back to a sump.

Another difficulty with such pumps is that the outlet pressure against which such a pump operates may vary depending on the nature of the flow demanded, and on the viscosity of the oil. For example, if the downstream load is closed, it is desirable to divert flow back to the pump inlet. As noted above, pressure relief valves are often used for this purpose. In a second example, under cold starting conditions hydraulic fluid may need to circulate for some time before reaching a steady operating temperature and moderate viscosity. A pump of sufficient size and power to run at full flow and pressure under these higher viscosity conditions may be significantly undersized relative to the normal operating conditions to which it will be exposed. In either case a pump which continues-to work at full flow at the relief pressure is wasting a maximum amount of energy.

Whether the excess pressure is produced because the engine is running faster or because the fluid is cold, in all cases, rather than pressurizing fluid merely to force it through a pressure relief valve, it would be desirable to direct that fluid without pressurization to a bypass. If resistance in the bypass is small relative to the pressure relief, the potential energy saving is roughly equal to the flow re-directed multiplied by the difference between relief pressure and intake pressure.

A number of earlier inventors have described devices in the general field of this invention. U.S. Pat. No. 3,175,800 to Donner et al., discloses a pressure responsive spool multistage spool valve, but does not alter the fluid supplied to the system.

U.S. Pat. No. 2,446,730 to Wemp discloses a gerotor pump which works in cooperation with a spool valve to provide pressure relief on a pressure schedule varying with ambient temperature, but the relief valve otherwise operates in the conventional manner.

U.S. Pat. No. 3,224,662 to Oldenburg presents a two phase, or vapour cycle air conditioning system in which a radially sliding vane pump is used to compress gas emanating from a low pressure evaporator. Implicity, Oldenburg prevents liquid phase refrigerant from entering the compressor, and thereby causing damage, by providing an input pressure sensing signal to a reciprocating spool valve, causing the compressor to unload, or idle, when full cooling demand is not present.

U.S. Pat. No. 5,338,161 to Eley discloses a two lobed pump with sliding spool valve which may alternately direct hydraulic fluid to a load or to the pump inlet through an internal bypass passage, but the use of the spool valve is controlled by an operator and is intended to operate as an 'On'–'Off' control, in effect.

None of these earlier inventions provides a constant displacement pump which is self regulating in response to discharge pressure as in the present invention.

SUMMARY OF THE INVENTION

The present invention concerns a positive displacement pump for pumping a fluid from an intake condition to a discharge condition, that pump comprising a rotor, stator, and follower set having at least one inlet and at least two outlets; a valve controlling at least one of those outlets, that valve sequentially movable among at least (a) a full flow position, (b) a partial flow position, and (c) a pressure relief position; and that valve being responsive to the discharge condition.

In another aspect of the invention, the pump outlets include at least a first outlet and a last outlet; the pump comprises an intake, a discharge and a bypass passage; the bypass passage, intake, and inlet are in mutual fluid communication; the last outlet is in fluid communication with the discharge; the first outlet gives onto the valve; the valve comprises at least two exhaust ports, a first of them communicating with the discharge and a second one communicating with the bypass passage, and the bypass passage being in fluid communication with the intake; in a full flow position of the valve the first exhaust port being open and the second exhaust port being closed; and in partial flow and pressure relief positions of the valve the first exhaust port being closed and the second exhaust port being open.

In another aspect of the invention the valve comprises a pressure relief valve having a pressure relief port in fluid communication with the bypass passage; the last outlet is in fluid communication with the pressure relief valve and with the discharge; the pressure relief port is closed in the full and partial flow positions, and open in the pressure relief position, whereby in the pressure relief position the pressure relief port permits fluid to flow from the last outlet to the bypass passage.

In a further aspect of the invention the stator comprises a cavity having a cylindrical wall for containing the rotor and follower; the rotor is mounted eccentrically relative to the cylindrical wall; and the outlets are radial outlets disposed in the cylindrical wall whereby fluid departing the rotor, stator and follower set traverses that wall.

In one embodiment of the present invention there is disclosed a gerotor pump in which the rotor is an inner gerotor; the follower is an outer gerotor having a number of lobate teeth that is one greater than the number of lobate teeth of the inner gerotor, the follower having an equal number of tooth roots therebetween; those inner and outer gerotors engage to create a series of variable geometry chambers therebetween; the stator comprises a cylindrical surface for containing the rotor and follower, the cylindrical surface comprising at least two outlets; the follower has a mating cylindrical surface for sliding engagement within the cylindrical surface of the stator; the follower comprises radial ports, one disposed in each root, whereby during rotation of the follower within the stator the radial ports periodically and sequentially communicate with the outlets; the pump has an operating cycle comprising an intake cycle and an exhaust cycle; in the exhaust cycle fluid is expelled from each of the chambers in succession through those radial ports; the exhaust cycle comprises a .pressurizing portion; in the full flow position the pressurizing portion comprises that portion of the exhaust cycle in which each radial port is in fluid communication with any outlet; in the partial flow position the exhaust cycle comprises a bypass portion in which any one radial port is in fluid communication with the first outlet; and in that partial flow position the pressurizing portion comprises that portion of the exhaust cycle in which each radial port is in fluid communication with the balance of the outlet ports.

Alternatively, the gerotor pump may be constructed in an embodiment in which the rotor, stator, and follower set has at least three outlets; the valve controls at least two outlets; and the valve is movable among (a) a first, fully open position (b) a second, high reduced flow position (c) a third, low reduced flow position and (d) a fourth, pressure relief position.

BRIEF DESCRIPTION OF DRAWINGS

FIG. 1 is taken on section 'X—X' and FIG. 2 is taken on section 'Y—Y'

DETAILED DESCRIPTION OF THE BEST MODE FOR CARRYING OUT THE INVENTION

Figure 1A:
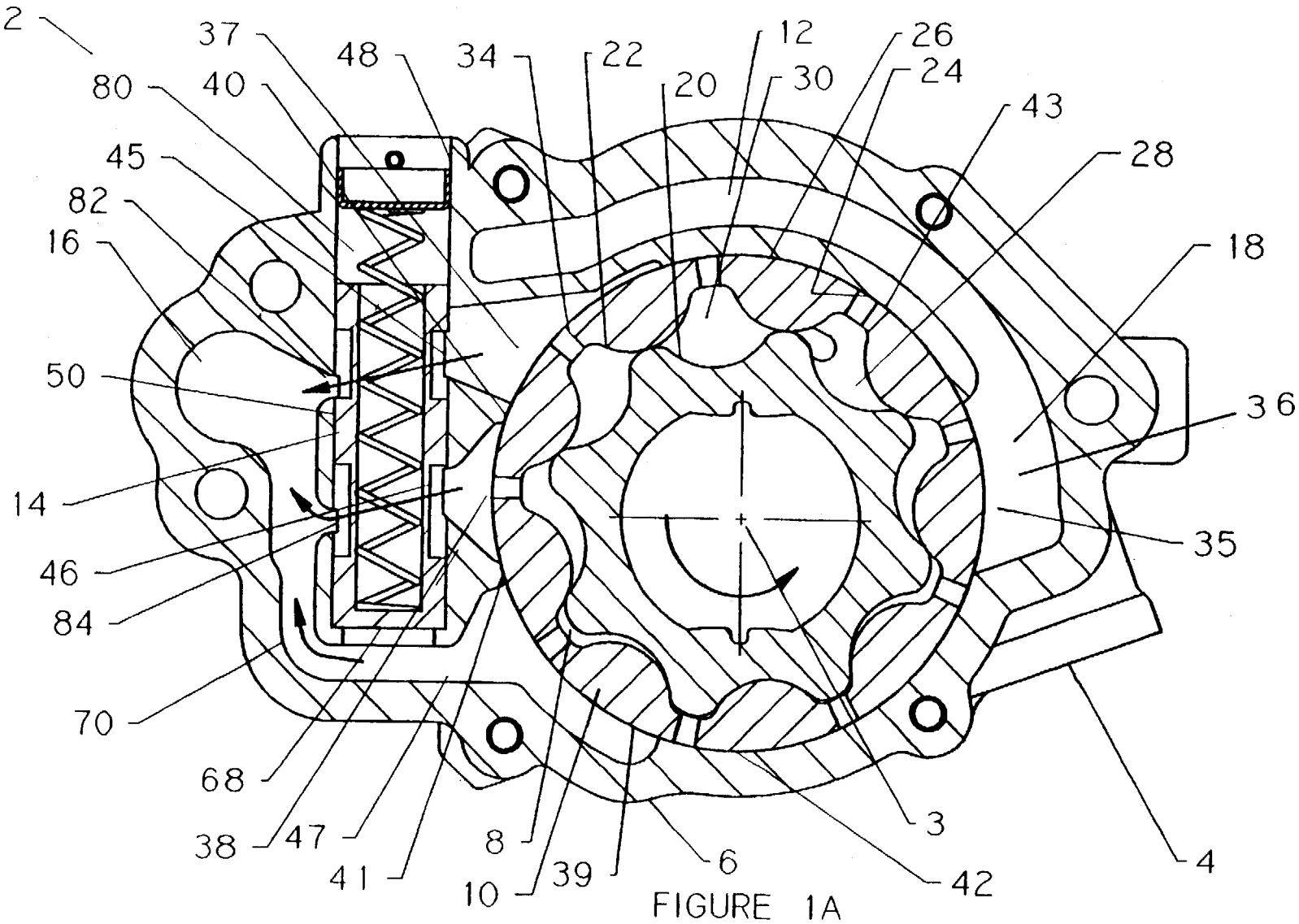
FIG. 1 is an horizontal cross section of the gerotor pump of the present invention, and comprises four sequential FIGS. 1*a*, 1*b*, 1*c*, and 1*d*.

Commencing with FIG. 1, a gerotor pump is shown generally as 2. This gerotor pump is one example, or species, of constant displacement, rotating pump having variable geometry chambers. The cross section of FIG. 1 is taken in a plane perpendicular to the axis of a drive shaft 3 by which the pump is driven. Drive shaft 3 transmits torque by a keyway or any mechanical equivalent to a keyway, and might include flats, as shown in FIG. 1, or splines. Pump 2 comprises a main inlet 4, a stator, or casing 6, an inner gerotor, or keyed lobate rotor 8, a correspondingly lobate outer gerotor or follower ring 10, a bypass passage, or return passage 12 cast into casing 6, a spool valve 14, a discharge 16 and an intake 18.

In the illustrated embodiment rotor 8 comprises eight lobate teeth 20 disposed for co-operation with the nine inwardly oriented lobate teeth 22 of follower ring 10, as is well known in the art. Casing 6 comprises a circular cylindrical surface 24 for close tolerance, sliding engagement with a mating external cylindrical face 26 of follower ring 10, and a perpendicularly planar face 28 upon which follower ring 10 may slide and rotate. For clarity the matching, upper perpendicular, opposed face 29 has not been shown in FIG. 1. Cylindrical surface 24 is eccentrically disposed relative to shaft 3 to which rotor 8 is mounted. Those skilled in the art will recognize that although a rotor, stator, and follower set of eight and nine teeth has been described mechanisms of this kind generally comprise a first gear of a number of teeth 'n', and a second gear of one more teeth, 'n+1', and which maintain line contact between the lobes of the rotor and follower. The minimum number of teeth will be determined by the number of outlets chosen. Due to the eccentric nature of the mounting a series of chambers 30 is formed between the opposed faces, the lobate surfaces of rotor 8 and the lobate surfaces of follower ring 10. These chambers approach zero volume at the closest point, or perihelion, of cylindrical surface 24 to shaft 3, and reach their maximum volume at the farthest point, or aphelion, therefrom.

Figure 2:
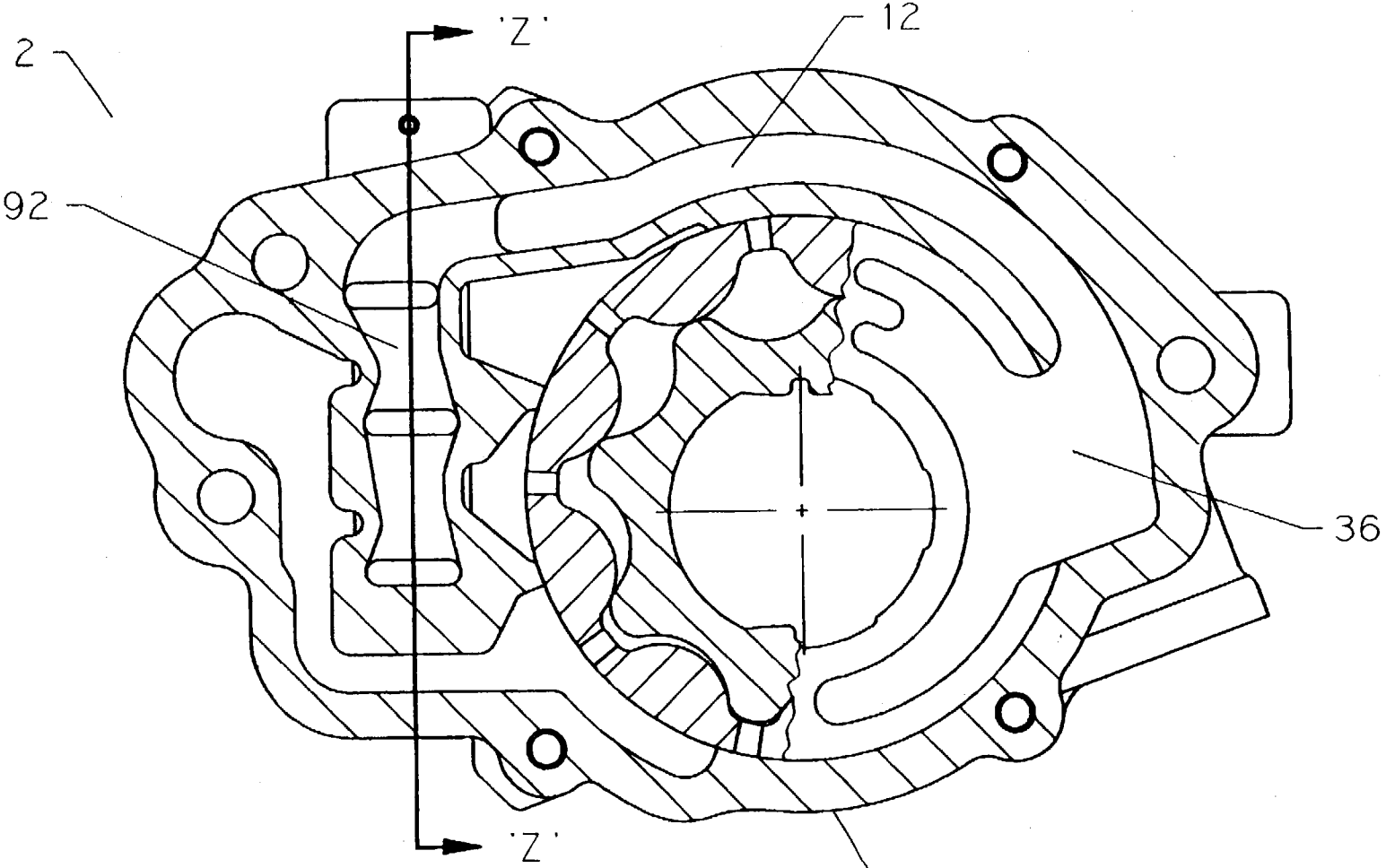
FIG. 2 is an horizontal cross section of the gerotor pump of the present invention taken in a plane parallel to and above that of FIG. 1 showing the geometry of the intake port and internal bypass flow passages.
Figure 3:
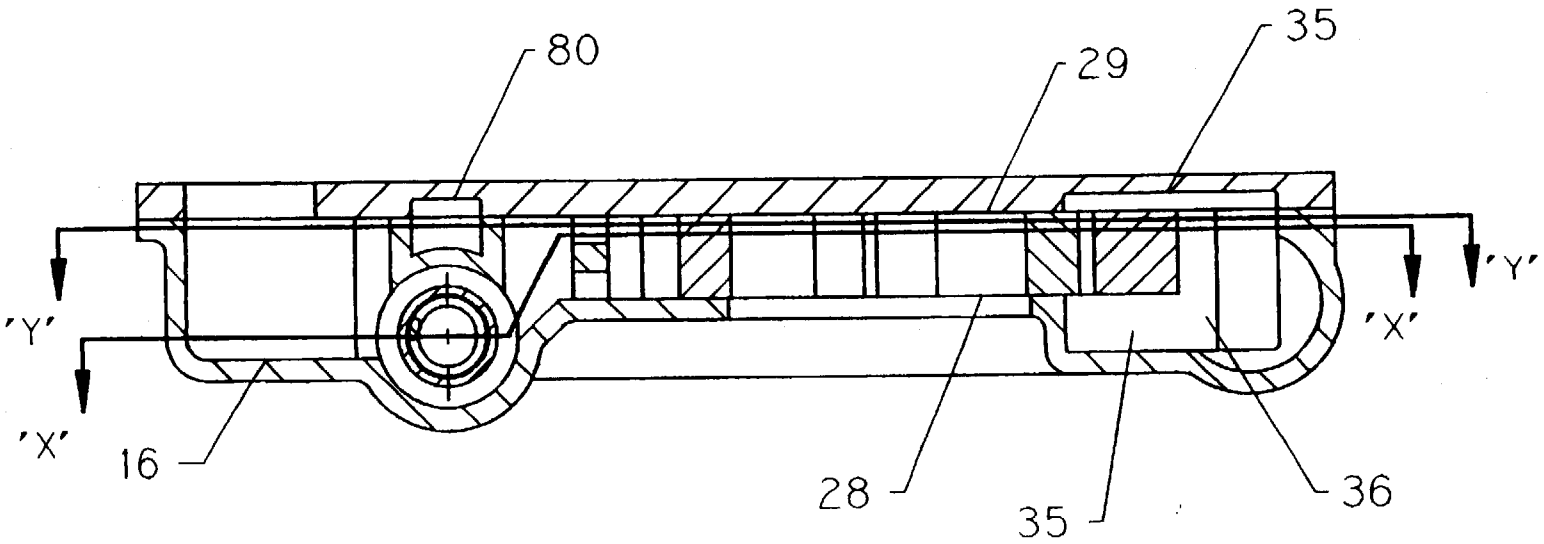
FIG. 3 is a partial vertical cross section showing the relationship of the cross sections shown in FIGS. 1 and 2.
Figure 4A:
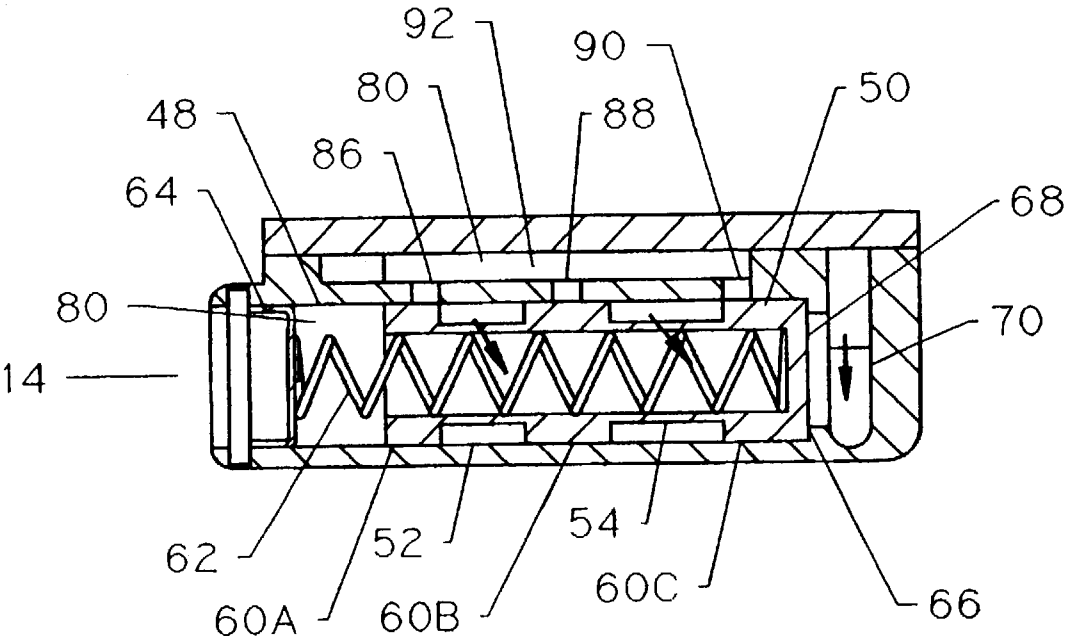
FIG. 4 shows a longitudinal section of a spool valve of the gerotor pump of FIG. 2 taken on section 'Z—Z' and includes four sequential FIGS. 4*a*, 4*b*, 4*c*, and 4*d* corresponding to FIGS. 1*a*, 1*b*, 1*c*, and 1*d*.
Figure 4B:
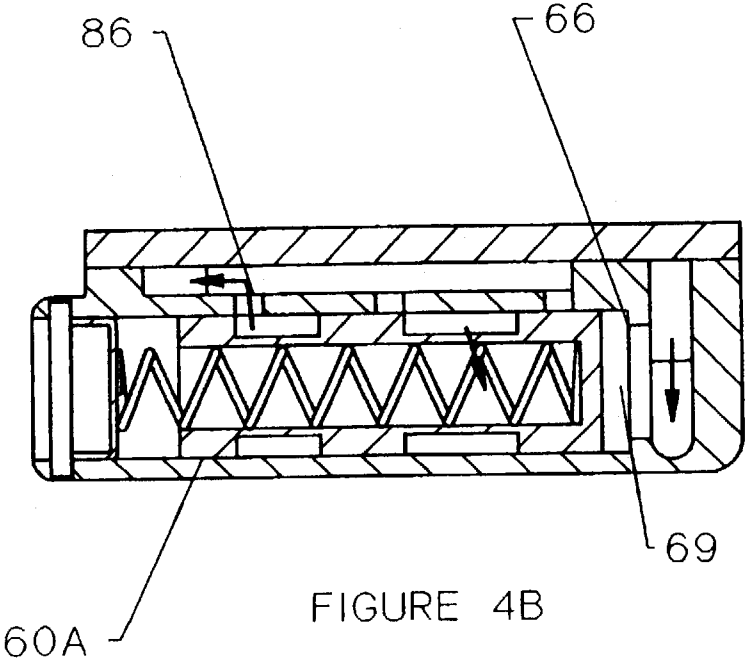
Figure 4C:
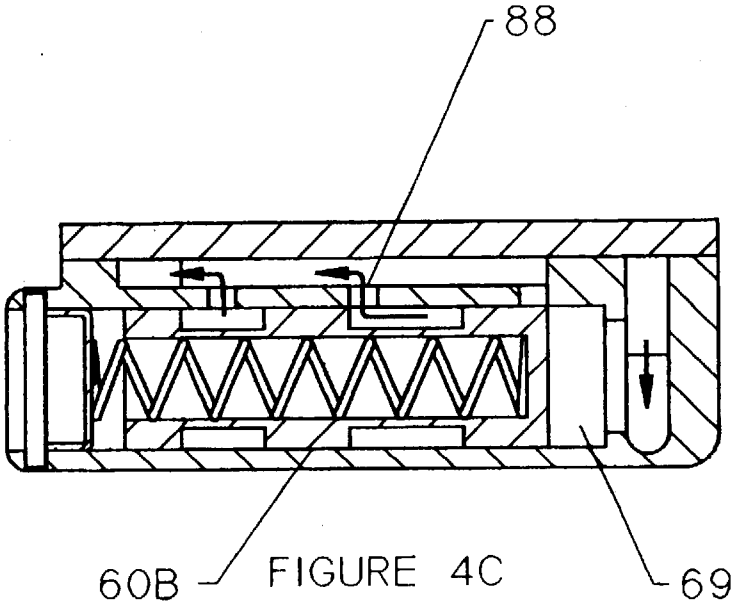
Figure 4D:
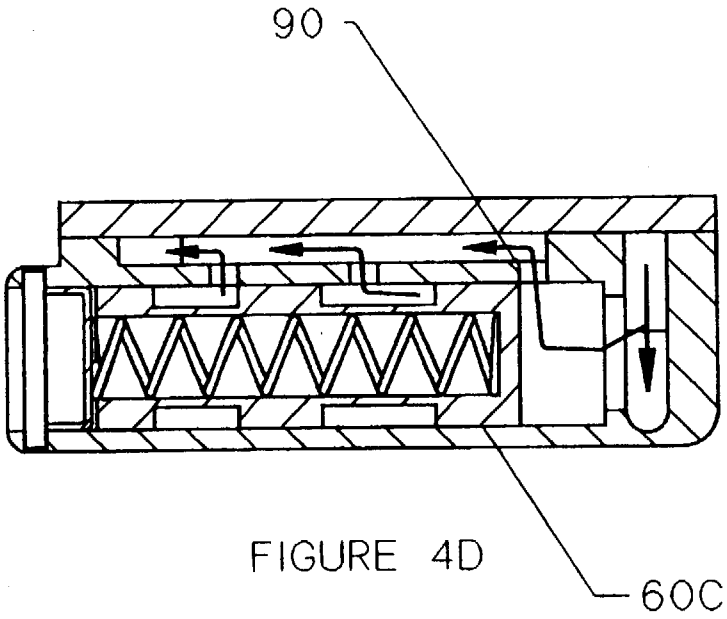

As illustrated, there is a radial port 34 radially traversing follower ring 10 at each root section intermediate two adjacent lobate teeth 22. It is more common in gerotor pumps for such ports to be located in the out-of-plane direction, that is to say for example, in planar face 28, or 29. As shown in FIG. 2, lower and upper perpendicular faces 28 and 29 comprise just such an intake port 35, which has a bifurcated arcuate shape subtending Toughly 165 degrees of arc to permit inflow into chambers 30 over roughly 180 degrees of rotation. Since, as shown in FIG. 3, that portion of the depth of intake port 35 below planar face 28 is greater than that portion above face 29, the majority of oil will enter chambers 30 from below. Casing 6 also comprises an inlet 36 and exhaust outlets 37, 38, and 39. Each of these outlets is disposed to align periodically with radial ports 34 such that fluid may exit corresponding chambers 30. Outlets 37 and 38 are separated by a first land 40 and outlets 38 and 39 are separated by a second land 41. Radial ports 34 will be blocked during that period of each cycle when sweeping past closed portion 42 of surface 24 between outlet 39 and inlet. 36 and again when sweeping past portion 43 between inlet 36 and outlet 37.

Gerotor pumps, or rotating vane pumps with variable geometry chambers have an operating cycle that may be divided into an intake cycle and an exhaust cycle. Considering one particular chamber 30, for example, the intake cycle commences when chamber 30 passes the aphelial point of the eccentric, at which chamber 30 has its minimum volume, approaching nil. As the pump continues to turn, counter-clockwise in the figures, chamber 30 expands, drawing in fluid through intake port 35. At the perihelial extremity, the intake cycle ends when the trailing edge of chamber 30 loses contact with intake port 35. Chamber 30 is at its maximum volume.

The exhaust cycle commences just as the leading edge of radial port 34 exposes the first edge of outlet 37, and continues until the trailing edge of radial port 34 clears the last edge of outlet 39, at which time chamber 30 is again reduced to its minimum, nearly nil, volume at the aphelion.

In the present invention the exhaust cycle may variously include both a first, bypass portion, and a second, pressurizing portion. If valve 14 is in the full flow position there will be no bypass portion and the pressurizing portion will occupy the entire exhaust cycle. In that case any diminution in the size of chamber 30 will expel the full flow of working fluid against the prevailing discharge pressure.

By contrast, in partial flow positions such as the high reduced flow position and the low reduced flow positions described below, the first portion of the exhaust cycle will expel fluid from chamber 30 through radial port 34, then through an outlet, such as outlet 37, to valve 14, manifold 92 and passage 12 whence it returns to intake 18. This bypass portion is followed by a pressurizing portion corresponding to that part of the exhaust cycle in which chamber 30 expels fluid through the balance of outlets, such as outlet 39, which are in fluid communication with discharge 16, and hence sensible to that higher discharge pressure.

Exhaust outlets 37, 38, and 39 each converge toward a corresponding throat, 45, 46, and 47, the first two of which give onto or communicates with spool valve 14. As is best seen in FIGS. 1 and 4, spool valve 14 comprises a hollow cylinder 48 machined into casing 6 and a multi-chamber bobbin 50 disposed for close fitting slidable motion thereal-long. In the embodiment described herein bobbin 50 has two waists, 52 and 54, although the present invention could be practised with a larger number of waists as may be found convenient. In general spool valves of this kind have square shouldered waists, or rebates, although they need not have, provided a flow passageway is created between the cylinder wall and the hollowed out waist portion of the bobbin. In the illustrated embodiment bobbin 50 has three pistons, indicated in FIG. 4*a* as 60*a*, 60*b*, and 60*c*. Bobbin 50 is hollow. A return spring 62 has a first end disposed within bobbin 50 and a second end captured by end cap 64, which also serves to close off and seal the otherwise open end of cylinder 48. A hollow abutting shoulder 66 limits travel of bobbin 50 away from end cap 64 and ensures that face 68 of piston 60*c* is exposed to the static pressure prevailing in that portion of casing 6 contiguous with a passage 70 leading from throat 47. Face 68 is thus sensible to the prevailing discharge pressure. In this way face 68 performs the functions of both a position control sensing device responsive to the discharge condition of the fluid, in this case responsive to the discharge pressure, and as transducer which converts that sensed pressure into a mechanical signal, or mechanical motion to move the spool valve 14 away from its fully opened position as pressure increases. Any number of electromechanical or hydraulic devices and linkages would serve this purpose. In the preferred embodiment use of the last piston 60*c* in this way permits the sensing and transducing functions to be performed with a very small number of parts—a piston and piston face—which are directly connected, are directly in line with, and form an inseparable part of, bobbin 50 of spool valve 14.

As seen in FIGS. 1 and 2, return passage 12 has been formed in casing 6 for carrying fluid from a passage, or manifold 92, generally disposed above cylinder 48, to the intake side of the pump generally, and to the vicinity of inlet 36 in particular. As seen in FIGS. 1 and 4 cylinder 48 intersects, and is in fluid communication with throat 45 and throat 46. Cylinder 48 also intersects apertures 82, and 84 through which fluid may under certain conditions flow to discharge 16. Finally, cylinder 48, intersects three bypass ports 86, 88, and 90, which give onto or communicates with manifold 92. Antechamber 80 of valve 14 adjacent cap 64 is vented to passage 92 as well to prevent oil from being trapped behind bobbin 50.

The series of drawings of FIGS. 1*a*, 1*b*, 1*c*, and 1*d*, showing sequential positions of bobbin 50 further helps to explain the action of spool valve 14. FIG. 1*a*, illustrates a first, full flow position in which the pressure at discharge 16 is relatively low, either because the motor driving the pump is only turning slowly, or because there is little downstream flow resistance. Under these conditions the full flow of fluid expelled from any chamber 30 is directed to discharge 16 and none is directed to passage 12. For example, this may be any condition up to a given discharge pressure, perhaps 50 psig. Piston 60*c* remains seated against hollow shoulder 66. Throats 45 and 46 are open to cylinder 48 and ports 82 and 84 permit fluid to flow across the space provided by waists 52 and 54 and exit to discharge 16. Passage 70 is in unimpeded fluid communication with discharge 16. Ports 86, 88 and 90 are closed off by pistons 60*a*, 60*b* and 60*c*.

Figure 1B:
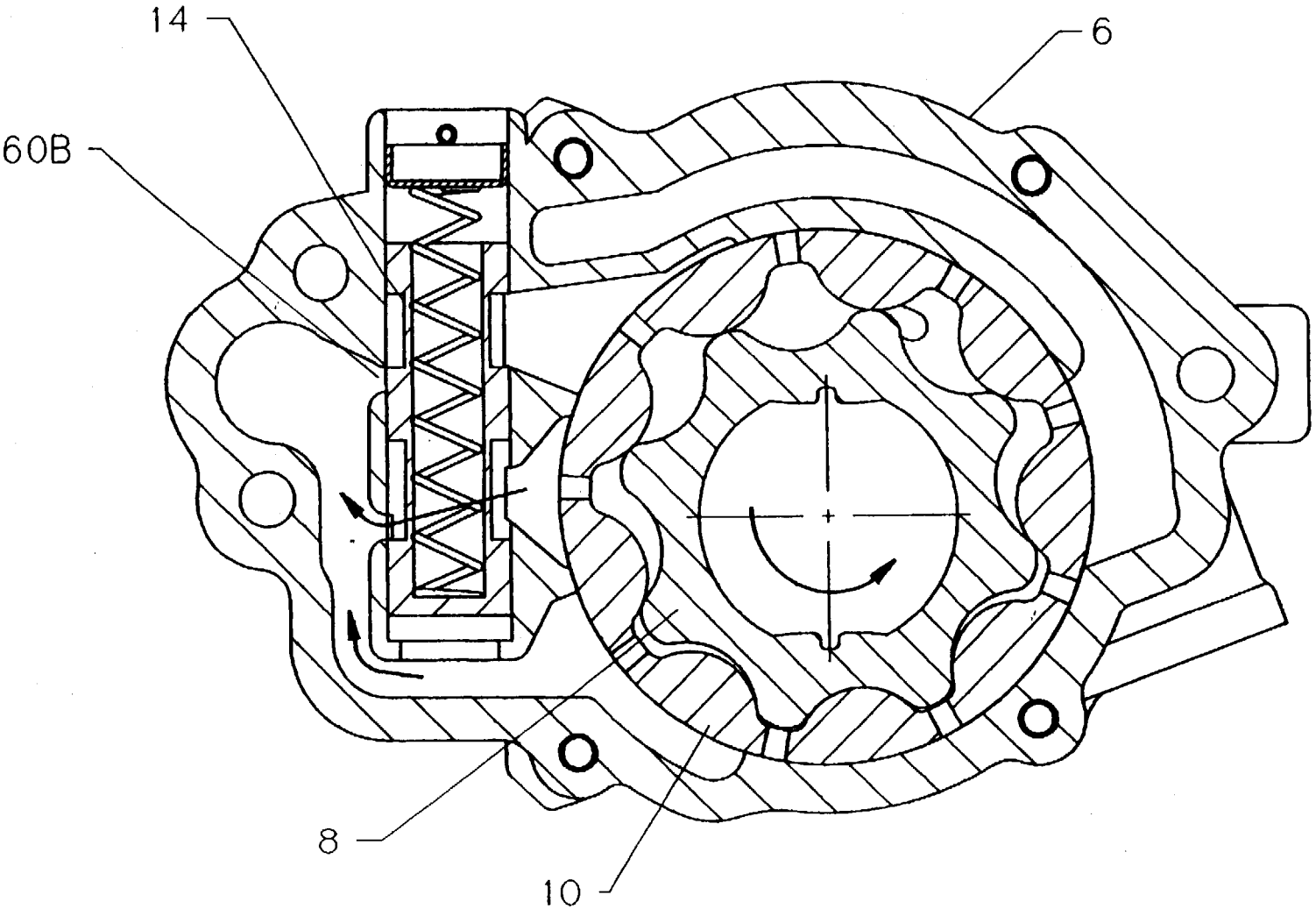

As the pump speed, outflow, and resistance in the load increases the static pressure sensed at face 68 of piston 60*c* also increases, eventually lifting face 68 off shoulder 66 and moving piston 60*b* to occlude exit port 82 as shown in FIG. 1*b*. This may be designated as a partial flow, or high reduced flow position. This is a partial flow position because only part of the flow is directed to discharge 16 while another part is directed to passage 12. Just as exit port 82 is closed, first bypass return port 86 opens, permitting fluid to flow upwardly into, and along manifold 92 in fluid communication with bypass or return passage 12. The pressure of the fluid discharged along this path is only greater than the pump inlet pressure, or relative vacuum, by an amount determined by the fluid resistance in those passages. This amount is small relative to load pressures. The work required to move fluid through return passage 12 is correspondingly small. Land 40 serves to segregate this unpressurized flow from the higher pressure required to force hydraulic fluid out discharge 16. For example, if the first discharge pressure were as above, the exit port 82 would close at 50 psig.

Figure 1C:
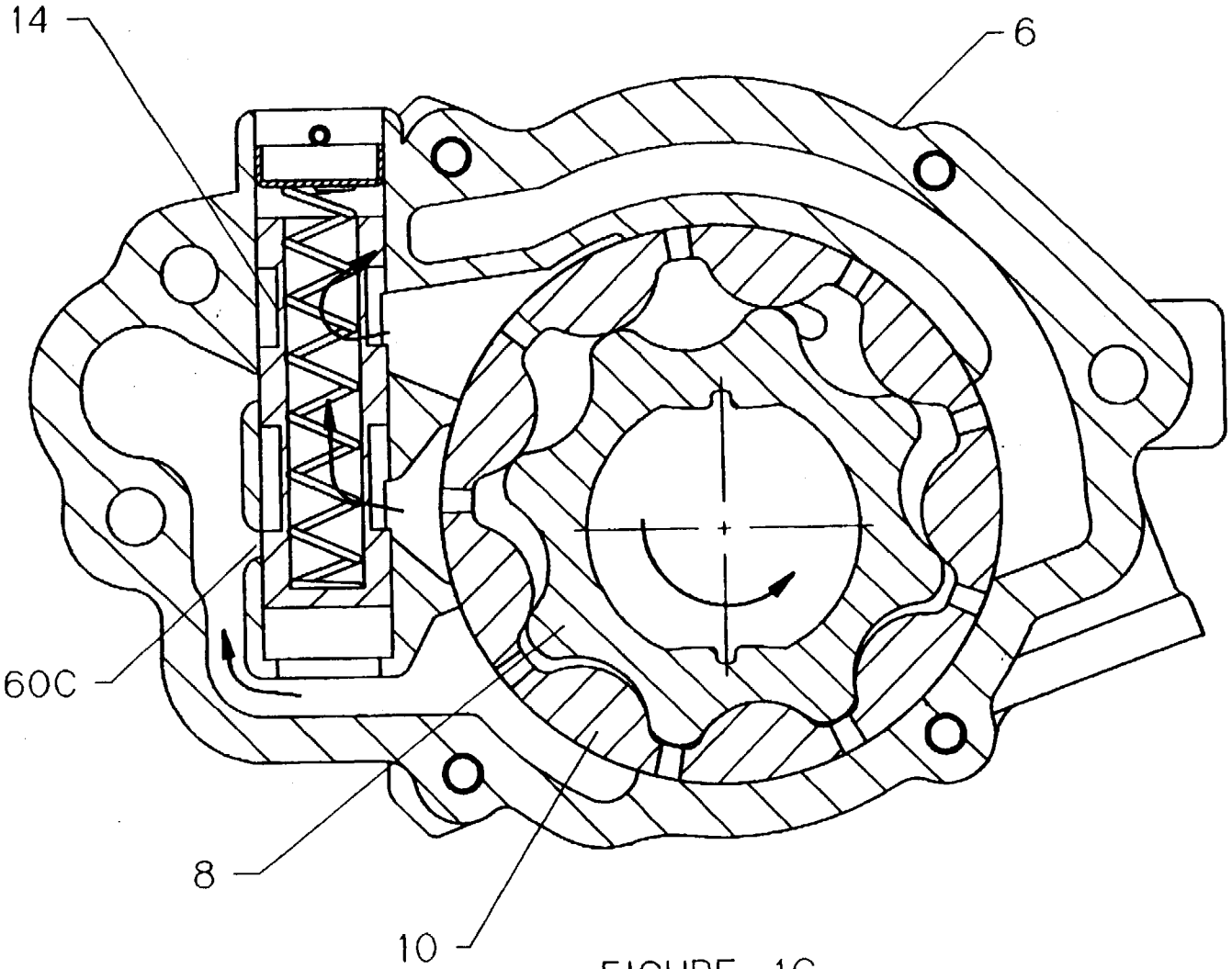

As the static pressure sensed at discharge 16, and hence in a cavity 69, increases yet further, bobbin 50 will be displaced further toward end cap 64. Eventually, as shown in FIG. 1*c* corresponding to another partial flow, or low reduced flow position, piston 60*c* will occlude exit port 84 and open return port 88, causing more flow to be directed to return and less to flow to the load. In this instance land 41 segregates unpressurized fluid from pressurized discharge through port 39 and throat 43. For example, if the first discharge pressure is arbitrarily set at 50 psig, this condition may be reached when the discharge pressure is perhaps approximately 60 psig.

Figure 1D:
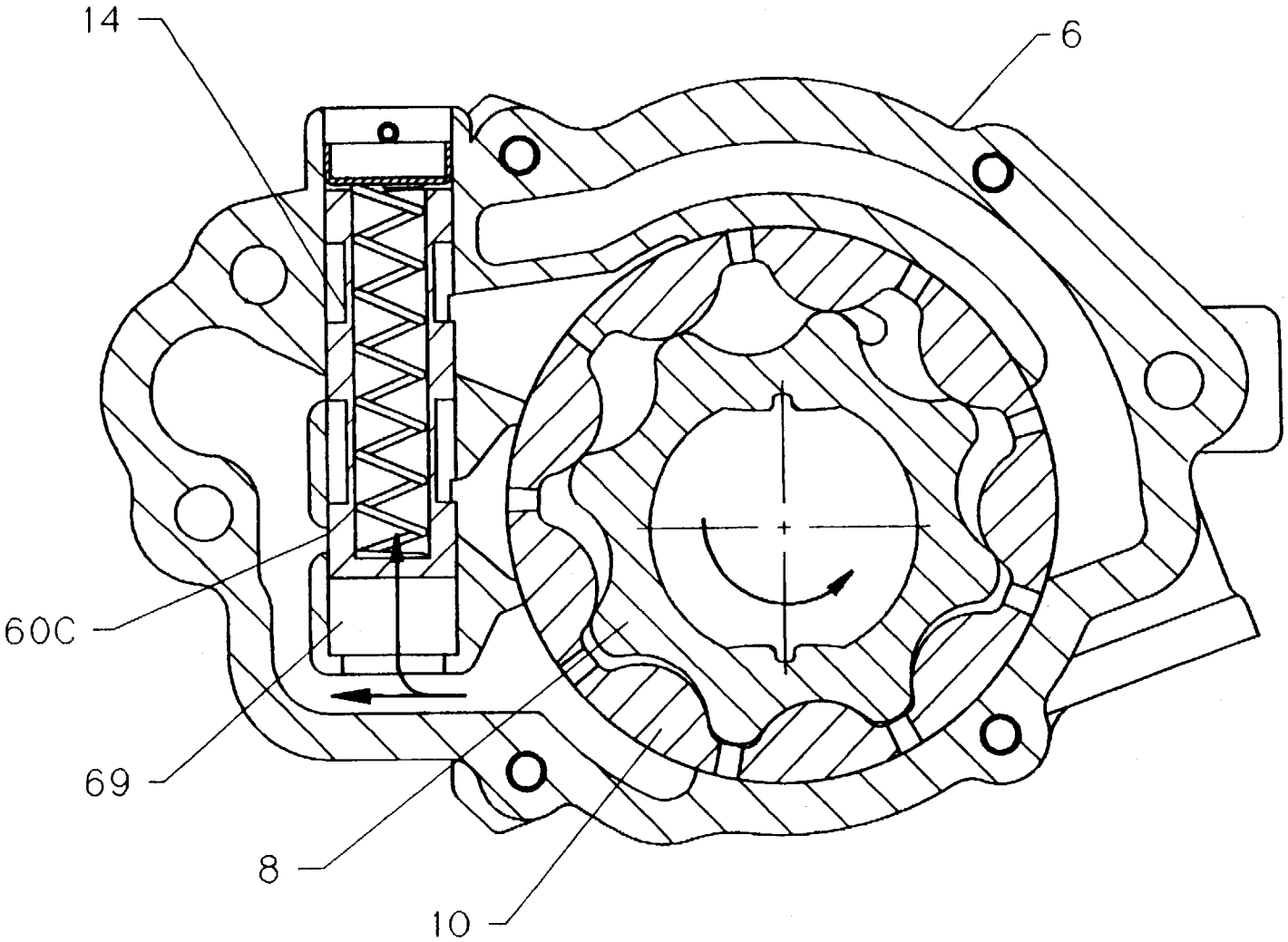

Finally, as shown in FIG. 1*d*, there is a pressure relief position in which the discharge pressure is so high that bobbin 50 has been displaced far enough for piston 60*c* to uncover port 90, which is, in effect, a high pressure relief valve. Port 90 is only partially uncovered leaving a slit, or orifice, such that the pressure drop across the orifice corresponds to some pressure greater than the relief pressure. Consistently with the above example, this pressure relief might occur at 70 psig. These example values are arbitrarily chosen, and are merely intended to illustrate that at each stage the discharge pressure is increasing. In the pressure relief mode the work done to compress the fluid to the relief pressure is lost, but this amount is less than the full flow by the mount vented through ports 86 and 88. The continued circulating flow through pump 2 also discourages overheating when the discharge is shut off.

In general the present invention may be extended to a variable geometry chamber, constant displacement pump having a plurality of outlets giving or communicates sequentially onto a suitable valve. Of those outlets at least one, the last, corresponding to outlet 39, is in fluid communication with discharge 16. For each outlet giving onto the valve, in this case spool valve 14, there are two exhaust ports. For example, in the preferred embodiment outlet 37 corresponds to a first exhaust port, aperture 82, which leads to discharge 16, and a second exhaust port, bypass port 86, which leads to the bypass, or return passage 12. Similarly outlet 38 corresponds to aperture 84 and bypass port 88. The valve 14, and more particularly bobbin 50, reciprocates sequentially between the full flow and pressure relief positions as pressure increases or decreases, traversing intermediate positions in order.

As noted, spool valve 14 is self actuating, responding to load conditions at the outlet. Although flow through the pump may increase in absolute terms as the motor driving the pump turns more quickly, the flow displaced per revolution decreases. In this sense the flow is reduced relative to the fully open flow that would otherwise occur at that rate of revolution. The spool valve cuts back the flow as the outlet pressure increases, that is to say, as the pump becomes more heavily loaded or as it is driven more rapidly by, for example, an accelerating motor. It permits maximum flow per revolution when the pump is unloaded, or if the rotor is being driven at a lower speed, such as idle.

The principles of the present invention may be practised, with suitable modifications, with a gerotor pump of any chosen number of lobes which satisfy the condition that the spool have at least three regimes, the first being a fully open flow, the second a partially open flow, and the third a pressure relief flow. Similarly the principles of the present invention may also be practised with reciprocating vane pumps, the efficacy thereof depending on the quality of the seals.

Although the illustrative embodiment of the present invention herein is described with reference to the accompanying drawings, it is understood that the invention is not limited to that precise embodiment and that various changes and modifications may be effected therein by those skilled in the art without departing from the scope, substance, or spirit of the invention.

I claim:

1. A positive displacement pump for pumping a fluid from an intake condition to a discharge condition, said pump comprising:

a rotor, stator, and follower set having at least one inlet and at least two outlets;

a valve controlling at least one of said outlets, said valve sequentially movable among at least (a) a full flow position, (b) a partial flow position, and (c) a pressure relief position;

an intake, a discharge, and a bypass passage;

said valve sensible to pressure at said discharge;

said valve tending to move from said full flow position as said discharge pressure increases;

said outlets include at least a first outlet and a last outlet;

said bypass passage, said intake, and said inlet are in mutual fluid communication;

said last outlet is in fluid communication with said discharge;

said first outlet communicates with said valve;

said valve comprises at least two exhaust ports, a first of said exhaust ports communicating with said discharge and a second of said exhaust ports communicating with said bypass passage, and said bypass passage in fluid communication with said intake;

in said full flow position of said valve said first exhaust port being open and said second exhaust port being closed;

and in said partial flow and pressure relief positions of said valve said first exhaust port being closed and said second exhaust port being open.

2. The positive displacement pump of claim 1 wherein said valve comprises a pressure relief valve having a pressure relief port in fluid communication with said bypass passage;

said last outlet is in fluid communication with said pressure relief valve and with said discharge;

said relief port is closed in said full and partial flow positions and open in said pressure relief position, whereby in said pressure relief position said pressure relief port permits fluid to flow from said last outlet to said bypass passage.

3. The positive displacement pump of claim 2 wherein said valve is a spool valve and said pump comprises biasing means to urge said spool valve to said full flow position.

4. The positive displacement pump of claim 3 wherein said spool valve comprises at least one discharge pressure sensing face disposed in opposition to said biasing means whereby an increase in discharge pressure sensed at said face tends to move said valve away from said first position.

5. The constant displacement pump of claim 4 wherein said spool valve comprises a bobbin and said pressure sensing face is a piston head disposed at one end of said bobbin and said biasing means is a spring and said piston head is disposed to work in opposition thereto.

6. The positive displacement pump of claim 1 wherein said pump is a gerotor pump in which:

said rotor is an inner gerotor having lobate teeth;

said follower is an outer gerotor having a number of lobate teeth that is one greater than the number of lobate teeth of said inner gerotor, and an equal number of tooth roots therebetween; and said inner and outer gerotors engaging to create a series of variable geometry chambers therebetween.

7. The gerotor pump of claim 6 wherein:

said stator comprises a cylindrical surface for containing said rotor and said follower, said cylindrical surface comprising at least two outlets;

said follower has a mating cylindrical surface for sliding engagement within said cylindrical surface of said stator; and said follower comprises radial ports, one disposed in each said root, whereby during rotation of said follower within said stator said radial ports periodically and sequentially communicate with said outlets.

8. The gerotor pump of claim 7 wherein:

said pump has an operating cycle comprising an intake cycle and an exhaust cycle;

in said exhaust cycle fluid is expelled from each of said chambers in succession through said radial ports;

said exhaust cycle comprises a pressurizing portion;

in said full flow position said pressurizing portion comprises that portion of the exhaust cycle in which each said radial port is in fluid communication with any of said outlets;

in said partial flow position said exhaust cycle comprises a bypass portion in which one of said radial ports is in fluid communication with said first outlet; and in said partial flow position said pressurizing portion comprises that portion of the exhaust cycle in which each said radial port is in fluid communication with the balance of said outlet ports.

9. A positive displacement pump for pumping a fluid from an intake condition to a discharge condition, said pump comprising:

a rotor, stator, and follower set having at least one inlet and at least two outlets;

a valve controlling at least one of said outlets, said valve sequentially movable among at least (a) a full flow position, (b) a partial flow position, and (c) a pressure relief position;

said valve responsive to said discharge condition, said stator comprises a cavity having a cylindrical wall for containing said rotor and said follower;

said rotor is mounted eccentrically relative to said cylindrical wall; and said outlets are disposed in said cylindrical wall whereby fluid departing said rotor, stator and follower set traverses said wall.

10. A positive displacement pump for pumping a fluid from an intake condition to a discharge condition, said pump comprising:

a rotor, stator, and follower set having at least one inlet and at least three outlets;

a valve controlling at least two of said outlets, said valve is movable among (a) a first fully full flow position, (b) a second high reduced flow position, (c) a third, low reduced flow position; and (d) a fourth pressure relief position;

said valve responsive to said discharge condition.

11. The positive displacement pump of claim 10 wherein:

said pump comprises an intake, a discharge, and a bypass passage;

said inlet, said intake and said bypass passage are in mutual fluid communication;

said valve is a spool valve sensible to pressure at said discharge, said valve tending to move from said first position to said second position on a first increment in discharge pressure, said valve tending to move from said first position as said discharge pressure increases.

12. The positive displacement pump of claim 11 wherein:

said outlets include at least a first outlet, a second outlet, and a last outlet, and at least said fast and second outlets communicate with said valve;

said valve controls at least said first and second outlets;

said valve comprises at least fast and second exhaust ports corresponding to each outlet communicating thereonto;

each first exhaust port is in fluid communication with said discharge;

each second exhaust port is in fluid communication with said bypass passage;

in said first position all said first exhaust ports are open and all said second exhaust ports are closed;

in said second position said first exhaust port corresponding to said first outlet is closed, said second exhaust port corresponding to said first outlet is open, all other first exhaust ports are open and all other second exhaust ports are closed; and in said third position said first exhaust ports corresponding to said first and second outlets are closed, said second exhaust ports corresponding to said first and second outlets are open, all other tint exhaust ports are open and all other second exhaust ports are closed.

13. The positive displacement pump of claim 12 wherein:

said pump comprises a pressure relief valve having a pressure relief port in fluid communication with said bypass passage;

said last outlet is in fluid communication with said pressure relief valve and with said discharge;

said relief port is closed in said first, second and third positions and open in said fourth position;

in said fourth position said pressure relief port permitting fluid to flow from said last outlet to said bypass passage.

14. The positive displacement pump of claim 13 wherein:

said pump comprises biasing means to urge said valve to said first position; said valve comprises at least one discharge pressure sensing face disposed in opposition to said biasing means, an increase in discharge pressure sensed at said face tending to move said valve away from said first position; and said biasing means is a spring, said spool valve comprises a bobbin and said pressure sensing face is a piston head disposed at one end of said bobbin.

15. The positive displacement pump of claim 10 wherein:

said stator comprises a cavity having a cylindrical wall for containing said rotor and said follower;

said rotor is mounted eccentrically relative to said cylindrical wall; and said outlets are radial outlets disposed in said cylindrical wall whereby fluid departing said follower traverses said wall.

16. The gerotor pump for pumping a fluid from an intake condition to a discharge condition: said pump comprising:

said rotor, stator, and follower set having at least one inlet and at least three outlets;

said valve controlling at least two of said outlets;

said valve is moveable among (a) a first, fully open position (b) a second, high reduced flow position (c) a third, low reduced flow position and (d) a fourth, pressure relief position;

said valve responsive to said discharge condition;

said rotor is an inner gerotor having lobate teeth;

said follower is an outer gerotor having a number of lobate teeth that is one greater than the member of lobate teeth of said inner gerotor, and an equal number of tooth roots therebetween; and said inner an outer gerotors engaging to create a series of variable geometry chambers therebetween;

said stator comprises a cylindrical surface for containing said rotor and said follower, said cylindrical surface comprising at least three outlets;

said follower has a mating cylindrical surface for sliding engagement with said cylindrical surface of said stator; and said follower comprises radial ports, one displayed in each said root, whereby during rotation of said follower within said stator said radial ports periodically and sequentially communicate with said outlets.

17. The positive displacement pump of claim 16 wherein:

said pump comprises an intake, a discharge, and a bypass passage;

said intake, said inlet, and said bypass passage are in mutual fluid communication;

said pump has a cycle comprising an intake cycle in which said chambers are expanding and an exhaust cycle in which said chambers are shrinking;

in said first position said exhaust cycle comprises a pressurizing portion in which each said radial port is in fluid communication with any of said outlets;

in said second position said exhaust cycle comprises a bypass portion in which each said radial port is in fluid communication with said first outlet and a pressurizing portion in which each said radial port is in fluid communication with the balance of said outlet ports;

in said third position said exhaust cycle comprises a bypass portion in which each said radial port is in fluid communication with said first and second outlets and a pressurizing portion in which each said radial port is exposed to the balance of said outlets;

in said fourth position said exhaust cycle comprises a pressurizing portion in which each said radial port is exposed to said last outlet, and a bypass portion in which each said radial port is exposed to the balance of said outlets.

18. The gerotor pump of claim 17 wherein in said second, third and fourth positions said bypass portion precedes said pressurizing portion.

* * * * *